US005442990A

United States Patent [19]

Krohn

[11] Patent Number: 5,442,990

[45] Date of Patent: Aug. 22, 1995

[54] TRACKED VEHICLE

[76] Inventor: Walter Krohn, Pflanzenhof, D-56751 Masburg, Germany

[21] Appl. No.: 217,592

[22] Filed: Mar. 25, 1994

[30] Foreign Application Priority Data

Mar. 26, 1993 [EP] European Pat. Off. ..... 93105028

[51] Int. Cl.[6] ..... F41H 11/16

[52] U.S. Cl. ..... 89/1.13; 172/122

[58] Field of Search ..... 89/1.13; 172/811, 122, 172/123

[56] References Cited

U.S. PATENT DOCUMENTS

| | | | |
|---|---|---|---|
| 2,489,564 | 11/1949 | Du Toit | 89/1.13 |
| 2,496,423 | 2/1950 | Taylor | 89/1.13 |
| 4,765,221 | 8/1988 | Sombrowski | 89/1.13 |
| 4,932,831 | 6/1990 | White et al. | 414/732 |
| 4,987,819 | 1/1991 | Brown | 89/1.13 |
| 5,007,325 | 4/1991 | MacWatt | 89/1.13 |

FOREIGN PATENT DOCUMENTS

| | | |
|---|---|---|
| 914285 | 10/1946 | France . |
| 2430709 | 1/1976 | Germany . |

*Primary Examiner*—Charles T. Jordan
*Assistant Examiner*—Christopher K. Montgomery
*Attorney, Agent, or Firm*—Evenson, McKeown, Edwards & Lenahan

[57] ABSTRACT

A mine removal vehicle comprises a tracked vehicle, a frontal assembly operatively connected with the tracked vehicle in a liftable and lowerable manner, and a box connected to the frontal assembly which has a scarifying drum arranged in it transversely to the driving direction. The scarifying drum is lowered into the soil, rotating against the driving direction, transporting a mine toward the front of the scarifying drum and exploding it there by the application of pressure.

20 Claims, 2 Drawing Sheets

TRACKED VEHICLE

BACKGROUND AND SUMMARY OF THE INVENTION

This invention relates to a mine clearing vehicle comprising a tracked vehicle, and a frontal assembly operatively connected with the tracked vehicle in a liftable and lowerable manner using hydraulic or pneumatic cylinder—piston arrangements and frame members pivotally linked to the tracked vehicle. The frontal assembly comprises a box which is partially open on its front side and on its lower side, and a rotary scarifying drum arranged in the box essentially transversely to the driving direction, which is preferably hydraulically rotationally driven.

Tracked vehicles of the above-mentioned type have been known in practice for some time and are normally used for soil cultivation. Because of their particularly robust construction, they can be used for heavy forestry work, such as for moving or transporting felled trees and for clearing dirt roads.

Tracked vehicles are, among other things, also used for soil cultivation. A scarifying drum arranged in a frontal assembly—in front of the actual tracked vehicle—is used for cutting or combing through the upper soil layers, in which case plants, wood, rocks, etc. are cut up or broken up by the scarifying drum. The soil is turned over by the action of the scarifying drum in the upper soil layers, and the broken-up wood, rocks and the like are mixed with the soil.

The claimed vehicle in this case is a mine clearing vehicle for removing and clearing anti-personnel mines and anti-tank mines from a depth of up to 30 cm under the soil surface. Such a mine clearing vehicle is used particularly for the removal of forgotten mines, for example, in the area of old border installations at the so-called death strip of the former German Democratic Republic. In a conventional search for such mines, the technical search personnel are exposed to considerable danger. In addition, the persons working in the clearing of mines cannot cover the whole surface in searching the ground for mines, so undetected mines always remain in the ground and continue to present a considerable danger. In conventional mine clearing operations, metal detectors fastened to long rods are normally used to detect the mines. The actual clearing starts only after the mines are found, in which case the person removing the mine is always exposed to the danger of an unintentional triggering and explosion.

It is an object of the present invention to provide a safe method for clearing hidden mines. To achieve this object, the scarifying drum rotates against the driving direction and transports a mine toward the front of the scarifying drum, where the mine explodes as the result of the pressure applied by the scarifying drum.

To eliminate the danger of a tracked vehicle with a poorly protected body triggering a mine explosion, the box and scarifying drum are dimensioned such that they extend at least the width of the tracked vehicle. This ensures that the area in front of the tracked vehicle is safely ploughed through and the anti-personnel mines and anti-tank mines situated within approximately 30 cm under the soil surface are definitely detected.

It is advantageous for the rotational speed of the scarifying drum to be adjustable in a continuous manner. The rotating direction of the scarifying drum may also be reversible. This allows mines which cannot be exploded or other objects which cannot be destroyed to be moved out of the box and out of the range of the scarifying drum by reversing the direction of the scarifying drum. For this purpose, a type of collecting vessel may be associated with the box. Because the mines are hidden at different depths, it is another advantage for the cutting depth to be adjustable by means of cylinder—piston arrangements which lower or lift the box and the scarifying drum. Thus, when the scarifying drum is lowered, working depths of approximately one meter can be reached, so that mines which are situated up to a depth of one meter can be securely gripped.

It is advantageous for the frontal assembly to have a preferably hydraulically movable flap on its front side. The flap may be aligned in an upwardly projecting position such that it acts as a protective shield in the direction of the driver of the mine clearing vehicle. The flap may also be aligned in a downwardly projecting position to close the front side of the box so that mine explosions occurring inside or below the box are contained by the box. This effectively prevents the scattering of fragments.

If the flap is developed as a shield, it may be lockable in a position which is diagonally sloped toward the front in which it preferably projects in the upward direction.

It is particularly advantageous for the flap to be connected or disposed in a swivellable manner inside the box on two mutually opposite side walls. The front side of the box would then be substantially closable by means of the flap, as a result of a downwardly directed swivel movement. The flap would also function as a protective shield for the driver as a result of an upwardly directed swivel movement. Alternatively, the flap could be swivellably connected from the outside, to the front upper edge of the box. If the flap is used as a shield, it may be lockable in an upwardly projecting position. If the flap is used to close the box, it may be lockable in a downwardly projecting position. The box would then be closable by means of a downwardly directed swivel movement.

The scarifying drum reaches into the soil and rotates against the driving direction, transporting the soil to the front of the scarifying drum, against the flap which is in the closed position. The scarifying drum has preferably uniformly spaced cutting and breaking tools on the circumferential surface, which can pick up the mine from below and transport the mine toward the front of the scarifying drum. The pressure created by the scarifying drum forcing the mine against the soil in front of the scarifying drum can cause the mine to explode in the soil transported in front of the scarifying drum. If it is not possible to destroy the mine, which was removed from the soil, by explosion, the rotating direction of the scarifying drum may be reversed so that the unexploded mine is transported to the outside of the box.

If the explosion is to take place inside a closed box, the flap remains in the at least largely closed position during the mine clearance operation. If the protection is to take place only in the direction of the driver's cab, the flap can be folded up in the sense of a protecting shield.

It is advantageous for the scarifying drum to be swivellable in a horizontal plane so that the soil can be moved laterally out of the box. In this case, the swivel direction and the swivel angle can be adjusted.

With respect to a particularly sturdy embodiment of the present invention, it is advantageous for the box and optionally the flap to be designed such that they withstand explosions of tank mines of a weight of up to 7.5 kg. It is preferable that these components be manufactured of steel plates.

Finally, it is advantageous with respect to a particularly safe mine removal for the tracked vehicle constructed as the mine removal vehicle and for all functions of the tracked vehicle to be remotely controllable. An operator or a driver would therefore not be subjected to direct danger.

The present invention has the distinct advantage that operators of the mine clearing vehicle require no special professional training. In view of the simple use of the claimed mine-clearing vehicle, this vehicle may even be operated by drivers that have minimal on-the-job training. Also, it is not necessary that the driver of the present invention has special technical knowledge with respect to the mines to be removed.

Various possibilities exist to develop and further develop the teaching of the present invention in an advantageous manner. In this respect, reference is made, on the one hand, to the claims which follow claim 1 and, on the other hand, to the following explanation of an embodiment of the invention by means of the drawing. In connection with the explanation of the preferred embodiment of the invention by means of the drawing, generally preferred developments and further developments of the teaching will also be explained.

DETAILED DESCRIPTION OF THE DRAWINGS

Figure 1:
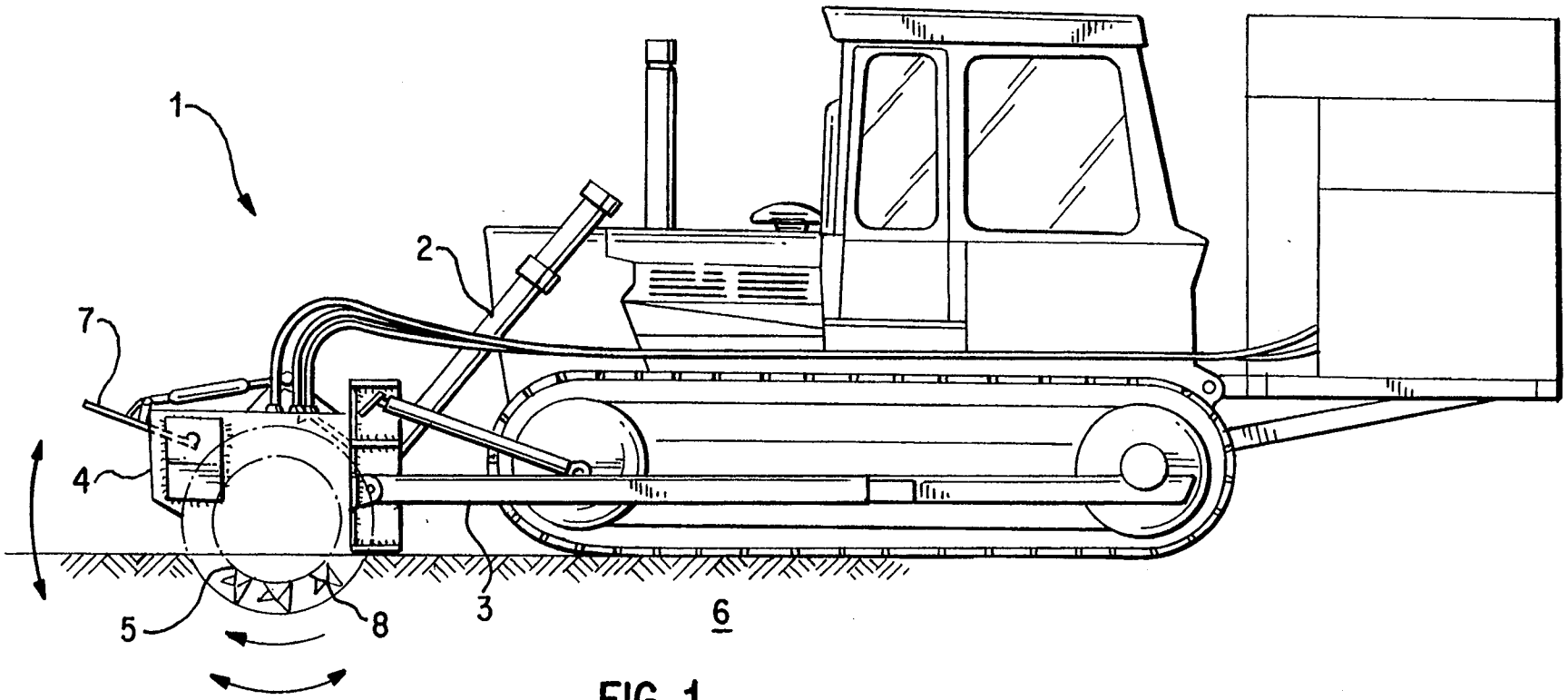
FIG. 1 is a schematic side view of a mine clearing vehicle in the form of an especially developed bulldozer which can be used as a mine clearing vehicle.

FIG. 1 illustrates a mine clearing vehicle. The mine clearing vehicle has a frontal assembly 1 which, by way of hydraulically operating cylinder-piston arrangements 2 and by way of frame pieces 3, which are pivotally connected with the tracked vehicle, is operatively connected with the tracked vehicle in a liftable and lowerable manner. Furthermore, a box 4 is provided which is partially open on its front side and on its lower side and has a hydraulically rotationally driven scarifying drum 5 arranged in it transversely with respect to the driving direction.

Figure 2:
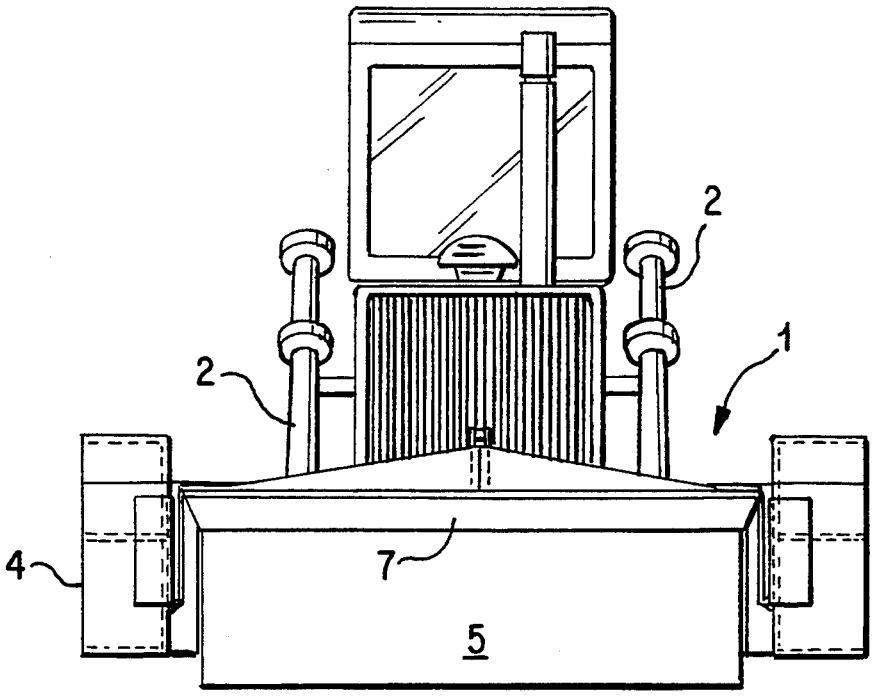
FIG. 2 is a frontal view of the object of FIG. 1.

FIGS. 1 and 2 show together that the box 4 extends the entire width of the tracked vehicle. The scarifying drum 5, in turn, extends along the entire width of the box 4.

In FIGS. 1 and 2, it is shown that the cutting depth can be adjusted by means of cylinder-piston arrangements 2 which lower or lift the box 4 and the frontal assembly 1.

FIG. 1 shows that the scarifying drum 5 reaches into the soil 6 to be searched for mines.

FIG. 1 also shows that the frontal assembly 1 has a swivellable flap 7 on its front side which acts as a shield. The embodiment illustrated here shows flap 7 locked in an upwardly projecting position, in the sense of a protective shield. Alternatively, the flap 7 could be locked in a downwardly projecting position, to be used for closing the front of the box 4.

Figure 3:
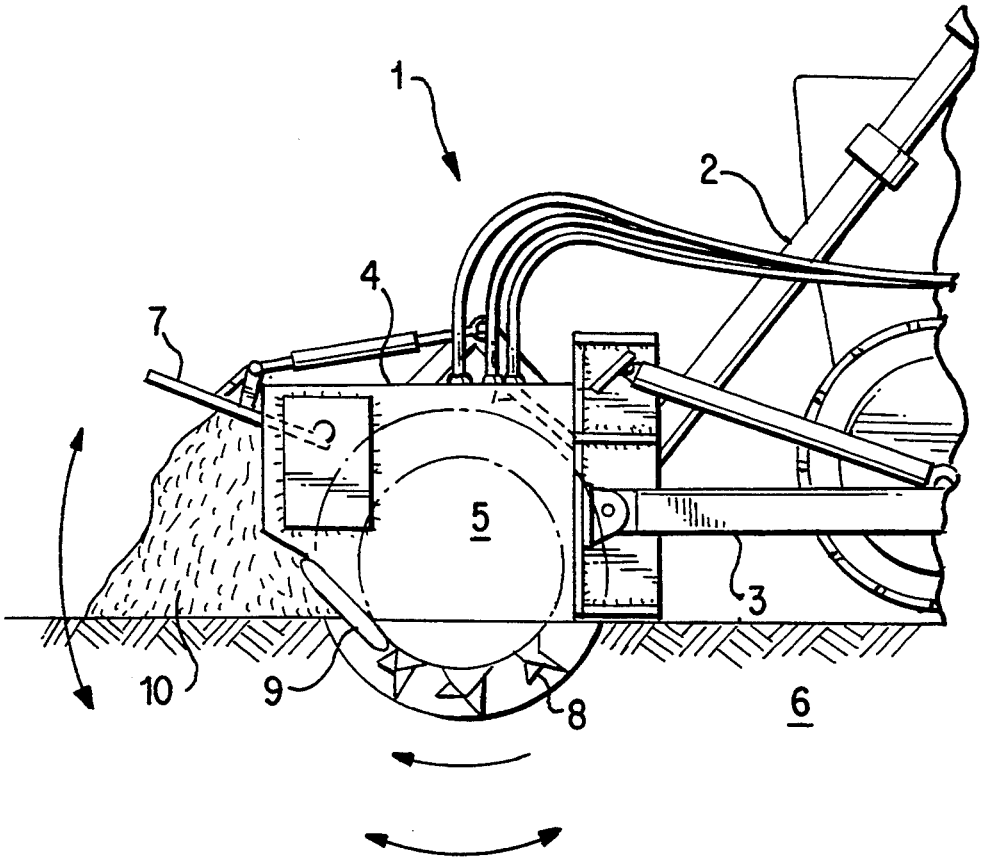
FIG. 3 is an enlarged representation of the object of FIG. 1 in the area of the frontal assembly.

In the embodiment shown in FIGS. 1 and 3, the scarifying drum 5 has approximately uniformly spaced cutting and breaking tools 8 on the circumferential surface. FIG. 3 shows that the mine 9 is picked up by the cutting and breaking tools 8 and is caused to explode in the soil 10 transported in front of the scarifying drum 5 because of the pressure exerted there on the mine 9.

Although, in the embodiment illustrated here, the flap 7 is in a position in which it forms a shield, the flap 7—if required—may be closed during the explosion of the mine 9. This would effectively prevent the scattering of fragments or the like.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A mine clearing vehicle comprising a tracked vehicle, a frontal assembly operatively connected with the tracked vehicle in a liftable and lowerable manner, the frontal assembly comprising a box which is partially open on a front side and on a lower side, and a rotary scarifying drum arranged in the box essentially transversely to a forward driving direction of the mine clearing vehicle, the scarifying drum rotating on a lower side against the driving direction and reaching into soil at a cutting depth to transport the soil and a mine toward a front side of the scarifying drum and explode the mine by the application of pressure.

2. A mine clearing vehicle according to claim 1, wherein the box is at least as wide as the tracked vehicle.

3. A mine clearing vehicle according to claim 1, wherein the scarifying drum is at least as wide as the tracked vehicle.

4. A mine clearing vehicle according to claim 1, wherein the rotational speed of the scarifying drum can be adjusted continuously.

5. A mine clearing vehicle according to claim 1, wherein the rotating direction of the scarifying drum can be reversed.

6. A mine clearing vehicle according to claim 1, wherein frame members pivotally connect the frontal assembly with the tracked vehicle.

7. A mine clearing vehicle according to claim 1, wherein hydraulic cylinder-piston arrangements lower or lift the frontal assembly to adjust the cutting depth of the scarifying drum.

8. A mine clearing vehicle according to claim 1, wherein pneumatic cylinder-piston arrangements lower or lift the frontal assembly to adjust the cutting depth of the scarifying drum.

9. A mine clearing vehicle according to claim 1, wherein the scarifying drum can be lowered into the soil up to a cutting depth of approximately 1 meter.

10. A mine clearing vehicle according to claim 1, wherein the frontal assembly has a flap on its front side which can be swivelled upwardly to function as a shield and downwardly to close the front side of the box.

11. A mine clearing vehicle according to claim 10, wherein the flap can be locked as a shield projecting diagonally upwardly.

12. A mine clearing vehicle according to claim 10, wherein the flap is swivellably mounted inside the box to two mutually opposite side walls.

13. A mine clearing vehicle according to claim 10, wherein the flap is pivotally attached to an upper edge of the box.

14. A mine clearing vehicle according to claim 10, wherein the scarifying drum moves the soil over the mine and against the flap, when the front side of the box is closed or partially closed.

15. A mine clearing vehicle according to claim 1, wherein the scarifying drum has uniformly spaced cutting or breaking tools on its circumferential surface which pick up the mine from below and cause the mine to explode in the soil transported in front of the scarifying drum because of the pressure of the scarifying drum forcing the mine against the soil.

16. A mine clearing vehicle according to claim 10, wherein the flap remains in a closed position during a mine removal operation.

17. A mine clearing vehicle according to claim 1, wherein the scarifying drum can be swivelled in a horizontal plane so that the soil can be moved laterally out of the box.

18. A mine clearing vehicle according to claim 17, wherein the scarifying drum has an adjustable swivelling direction and an adjustable swivelling angle.

19. A mine clearing vehicle according to claim 1, wherein the box is made of steel.

20. A mine clearing vehicle according to claim 10, wherein the flap is made of steel.

* * * * *